US011167191B2

(12) United States Patent
Anderle et al.

(10) Patent No.: US 11,167,191 B2
(45) Date of Patent: Nov. 9, 2021

(54) BALL BAT WITH ADJUSTABLE-WEIGHT END CAP

(71) Applicant: EASTON DIAMOND SPORTS, LLC, Thousand Oaks, CA (US)

(72) Inventors: John Anderle, Palmdale, CA (US); Dewey Chauvin, Simi Valley, CA (US); Linda Hunt, Simi Valley, CA (US); Grant Douglas, Santa Monica, CA (US); Ian Montgomery, Simi Valley, CA (US); Trevor Anderson, Oakland, CA (US)

(73) Assignee: EASTON DIAMOND SPORTS, LLC, Thousand Oaks, CA (US)

( * ) Notice: Subject to any disclaimer, the term of this patent is extended or adjusted under 35 U.S.C. 154(b) by 0 days.

(21) Appl. No.: 16/677,294

(22) Filed: Nov. 7, 2019

(65) Prior Publication Data

US 2020/0070020 A1 Mar. 5, 2020

Related U.S. Application Data

(63) Continuation of application No. 14/877,810, filed on Oct. 7, 2015, now Pat. No. 10,486,041.

(51) Int. Cl.

| | |
|---|---|
| ***A63B 69/00*** | (2006.01) |
| ***A63B 59/56*** | (2015.01) |
| ***A63B 60/02*** | (2015.01) |
| *A63B 71/06* | (2006.01) |

(52) U.S. Cl.

CPC ..... *A63B 59/56* (2015.10); *A63B 60/02* (2015.10); *A63B 69/0002* (2013.01); *A63B 2069/0008* (2013.01); *A63B 2071/0625* (2013.01)

(58) Field of Classification Search

CPC ..... A63B 59/56; A63B 60/02; A63B 69/0002; A63B 2069/0008; A63B 2071/0625; A63B 59/00; A63B 49/04; A63B 69/38; A63B 59/06

USPC ..... 473/564, 457, 437, 422, 519, 538, 568

See application file for complete search history.

(56) References Cited

U.S. PATENT DOCUMENTS

| | | | |
|---|---|---|---|
| 1,026,990 | A | 5/1912 | Matson |
| 1,030,982 | A | 7/1912 | Dinger |
| 1,499,128 | A | 6/1924 | Shroyer, Jr. |
| 1,603,904 | A | 10/1926 | Cohn |
| 3,116,926 | A | 1/1964 | Owen et al. |
| 3,392,976 | A | 7/1968 | Hayes |
| 3,508,748 | A | 4/1970 | Strimel |
| 3,521,883 | A | 7/1970 | Frank |

(Continued)

FOREIGN PATENT DOCUMENTS

WO 2012115813 A1 8/2012

OTHER PUBLICATIONS

Adidas Taylormade R7 Quad Driver, 2005.

(Continued)

*Primary Examiner* — Mitra Aryanpour
(74) *Attorney, Agent, or Firm* — Perkins Coie LLP

(57) ABSTRACT

An end-cap assembly for a ball bat or other sporting-good implement includes one or more removable weights, so that the weight of the end cap—and of the ball bat—may be adjusted. The one or more weights may reside in a receiving space or recess in an end-cap cup of the end-cap assembly. A fastener removably attaches the one or more weights to the end-cap cup. In some embodiments, the fastener may include threads that engage threads in a bore in the end-cap cup.

18 Claims, 14 Drawing Sheets

(56) References Cited

U.S. PATENT DOCUMENTS

| | | | |
|---|---|---|---|
| 3,578,801 | A | 5/1971 | Raymond |
| 3,834,697 | A | 9/1974 | McNamara, Jr. et al. |
| 3,861,682 | A | 1/1975 | Fujii |
| 4,200,285 | A | 4/1980 | Petitti et al. |
| 4,260,150 | A | 4/1981 | Tabet |
| 4,505,479 | A | 3/1985 | Souders |
| 4,819,935 | A | 4/1989 | Dirksing et al. |
| 5,277,421 | A | 1/1994 | Rewolinski |
| 5,465,967 | A | 11/1995 | Boeckenhaupt et al. |
| 5,494,280 | A | 2/1996 | Mackay et al. |
| 5,980,937 | A | 11/1999 | Guillot et al. |
| 6,022,281 | A | 2/2000 | Nolan et al. |
| 6,024,657 | A | 2/2000 | Bettencourt et al. |
| 6,254,498 | B1 | 7/2001 | Tyner et al. |
| 6,254,502 | B1 | 7/2001 | Becker |
| 6,280,353 | B1 | 8/2001 | Brundage et al. |
| 6,344,007 | B1 | 2/2002 | Feeney et al. |
| 6,461,259 | B1 | 10/2002 | Li et al. |
| 6,530,852 | B2 | 3/2003 | Rios et al. |
| 6,540,627 | B1 | 4/2003 | Leal et al. |
| 6,569,042 | B2 | 5/2003 | Lachance et al. |
| 6,875,137 | B2 | 4/2005 | Forsythe et al. |
| 6,905,429 | B2 | 6/2005 | Forsythe et al. |
| 6,974,396 | B2 | 12/2005 | Mauer et al. |
| 7,014,580 | B2 | 3/2006 | Forsythe et al. |
| 7,056,240 | B2 | 6/2006 | Brock et al. |
| 7,232,387 | B1 | 6/2007 | Heald et al. |
| 7,794,340 | B2 | 9/2010 | Mauer et al. |
| 8,371,154 | B2 | 2/2013 | Brandt et al. |
| 8,425,353 | B2 | 4/2013 | Jones et al. |
| 8,852,032 | B1 | 10/2014 | Barnes |
| 8,992,352 | B1 | 3/2015 | Meitz, III et al. |
| 2001/0034276 | A1 | 10/2001 | Brown et al. |
| 2002/0094888 | A1 | 7/2002 | Lachance et al. |
| 2004/0038758 | A1 | 2/2004 | Guenther et al. |
| 2004/0248676 | A1 | 12/2004 | Taylor et al. |
| 2005/0096159 | A1 | 5/2005 | Houston et al. |
| 2006/0025246 | A1 | 2/2006 | Forney et al. |
| 2007/0254751 | A1 | 11/2007 | Wilson et al. |
| 2007/0281806 | A1 | 12/2007 | Wong et al. |
| 2008/0009363 | A1 | 1/2008 | Solodovnick et al. |
| 2008/0280738 | A1 | 11/2008 | Brennan et al. |
| 2009/0131194 | A1 | 5/2009 | Keough et al. |
| 2009/0253539 | A1 | 10/2009 | Lovine et al. |
| 2010/0267523 | A1 | 10/2010 | Wilkinson et al. |
| 2011/0143870 | A1 | 6/2011 | Schulte et al. |
| 2012/0214622 | A1 | 8/2012 | Rockhill et al. |
| 2013/0196769 | A1 | 8/2013 | Shocklee et al. |
| 2013/0196795 | A1 | 8/2013 | Shocklee et al. |
| 2014/0274493 | A1 | 9/2014 | Heussner et al. |
| 2016/0089586 | A1 | 3/2016 | Sawyer et al. |

OTHER PUBLICATIONS

Adidas Taylormade R7 425 Driver, 2005.
Adidas Taylormade R7 425 TP Driver, 2005.
Adidas Taylormade R7 460 Driver, 2005.
Adidas Taylormade R7 Drivers, 2005.
Adidas Taylormade R7 Quad TP Driver, 2005.
Adidas Taylormade R7 460 Driver, 2006.
Adidas Taylormade R7 460 TP Driver, 2006.
Adidas Taylormade R7 Draw Driver, 2006.
Adidas Taylormade R7 SuperQuad TP Driver, 2007.
Adidas Taylormade R7 SuperQuad Driver, 2007.
Adidas Taylormade R7 SuperQuad TP 1st Driver, 2007.
Adidas Taylormade R7 CGB Max Limited Driver, 2008.
Adidas Taylormade R7 Limited TP Driver, 2008.
Adidas Taylormade R7 Limited Driver, 2008.
Adidas Taylormade R7XD Driver, 2009.
Demarini, Vizion Limited Edition Adjustable Slowpitch Bat, 2015.
USPTO Patent Trial and Appeal Board, Decision on Appeal in Appeal No. 2018-007235 for U.S. Appl. No. 14/877,810, mailed Apr. 26, 2019.
USPTO, Search Report and Written Opinion for PCT/US16/055840, dated Dec. 9, 2016.
Easton Diamond Sports, LLC, Pre-Appeal Brief Review Request filed in U.S. Appl. No. 14/877,810, Oct. 4, 2017.
USPTO, Notice of Panel Decision from Pre-Appeal Brief Review issued in U.S. Appl. No. 14/877,810, Oct. 30, 2017.
Easton Diamond Sports, LLC, Appeal Brief filed in U.S. Appl. No. 14/877,810, Jan. 3, 2018.
USPTO, Examiner's Answer issued in U.S. Appl. No. 14/877,810, dated May 8, 2018.
Easton Diamond Sports, LLC, Reply Brief filed in U.S. Appl. No. 14/877,810, Jul. 5, 2018.

BALL BAT WITH ADJUSTABLE-WEIGHT END CAP

CROSS-REFERENCE TO RELATED APPLICATION

This application is a continuation of U.S. patent application Ser. No. 14/877,810, filed Oct. 7, 2015 which is incorporated herein by reference in its entirety.

BACKGROUND

Softball and baseball players often choose different bat weights depending on game rules, style of play, field conditions, environmental conditions, and personal fatigue conditions. For example, players in a league that allows home runs may choose to use a heavier bat, while a player facing more challenging pitchers, or experiencing fatigue late in a game or season, may choose to use a lighter bat.

A bat's "swing weight" can be indicated by its moment of inertia ("MOI"). MOI is the product of: (a) mass, and (b) the square of the distance between the center of the mass and the point from which the mass is pivoted. Mathematically, this is expressed as follows:

$$MOI=\Sigma Mass\times(Distance)^2$$

The MOI dictates that it becomes increasingly difficult to swing a bat as the bat's mass increases or as the center of the bat's mass moves farther from the pivot point of the swing (i.e., farther from the batter's hands). A bat with a lower MOI is easier to swing, resulting in more control or a faster swing that can help the player meet a challenging pitch, while a heavier bat may limit the ability of the player to reach the pitched ball. But for a player with more strength and skill, or less fatigue, an increased MOI allows the player to impart more power on the ball, resulting in longer or faster hits than a bat with a lower MOI. For example, a player may be fresh and strong early in a season, tournament, or game and able to use a bat with a higher MOI, while the player may later need a bat with a lower MOI if the player is experiencing fatigue or is facing a challenging pitcher or adverse environmental conditions.

As a result of changing conditions, rules, or preferences, players may need to carry and use multiple bats to meet their needs. This can add cost and decrease a batter's confidence as a result of variations between different bats.

SUMMARY

An end-cap assembly for a ball bat or other sporting-good implement includes one or more removable weights, so that the weight of the end cap—and of the ball bat—may be adjusted. The one or more weights may reside in a receiving space or recess in an end-cap cup of the end-cap assembly. A fastener removably attaches the one or more weights to the end-cap cup. In some embodiments, the fastener may include threads that engage threads in a bore in the end-cap cup. Other features and advantages will appear hereinafter. The features described above may be used separately or together, or in various combinations of one or more of them.

BRIEF DESCRIPTION OF THE DRAWINGS

In the drawings, wherein the same reference number indicates the same element throughout the several views.

DETAILED DESCRIPTION

The present technology is directed to a ball bat having an adjustable-weight cap. Various embodiments of the technology will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments. Accordingly, the technology may have other embodiments with additional elements or without several of the elements described below with reference to FIGS. 1-12.

The terminology used in the description presented below is intended to be interpreted in its broadest reasonable manner, even though it is being used in conjunction with a detailed description of certain specific embodiments of the technology. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

Specific details of several embodiments of the present technology are described herein with reference to baseball or softball. The technology may also be used in other sporting good implements having caps.

The present technology provides ball bats with adjustable-weight end caps, which can provide multiple swing weights (i.e., MOI) in a single bat. The present technology also provides fasteners for weights in adjustable-weight end caps for improved safety. Examples of this technology are illustrated in FIGS. 1-12.

Figure 1:
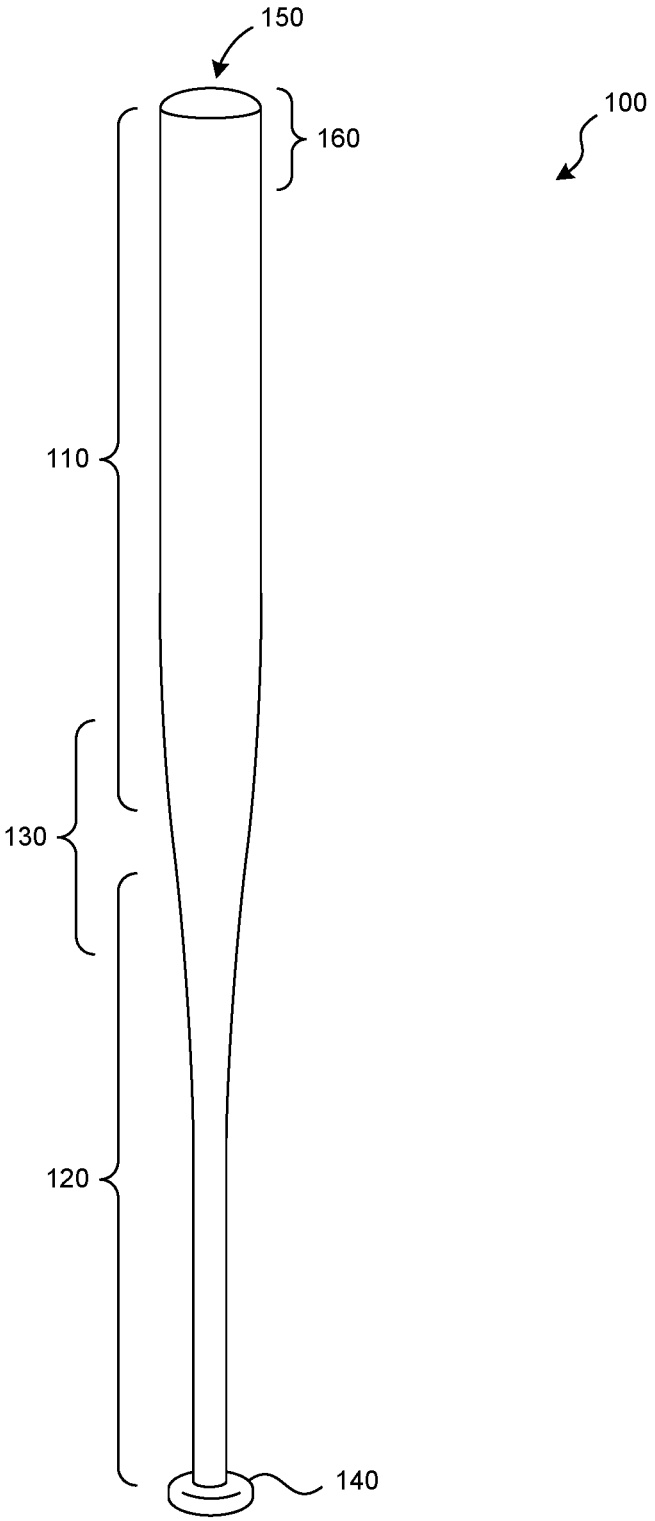
FIG. 1 is a perspective view of a ball bat in accordance with an embodiment of the present technology.

FIG. 1 illustrates a ball bat 100 having a barrel region 110 and a handle region 120. There may be a transitional or taper region 130 in which the larger diameter of the barrel region 110 transitions to the narrower diameter of the handle region 120. The handle region 120 may include an end knob 140, while a cap assembly 150 may be retained on or within the bat 100 at the distal end 160.

The bat 100 may have any suitable dimensions. The bat 100 may have an overall length of 20 to 40 inches, or 26 to 34 inches. The overall barrel diameter may be 2.0 to 3.0 inches, or 2.25 to 2.75 inches. Typical ball bats have diameters of 2.25, 2.625, or 2.75 inches. Bats having various combinations of these overall lengths and barrel diameters, or any other suitable dimensions, are contemplated herein. The specific preferred combination of bat dimensions is generally dictated by the user of the bat 100, and may vary greatly between users.

Figure 2:
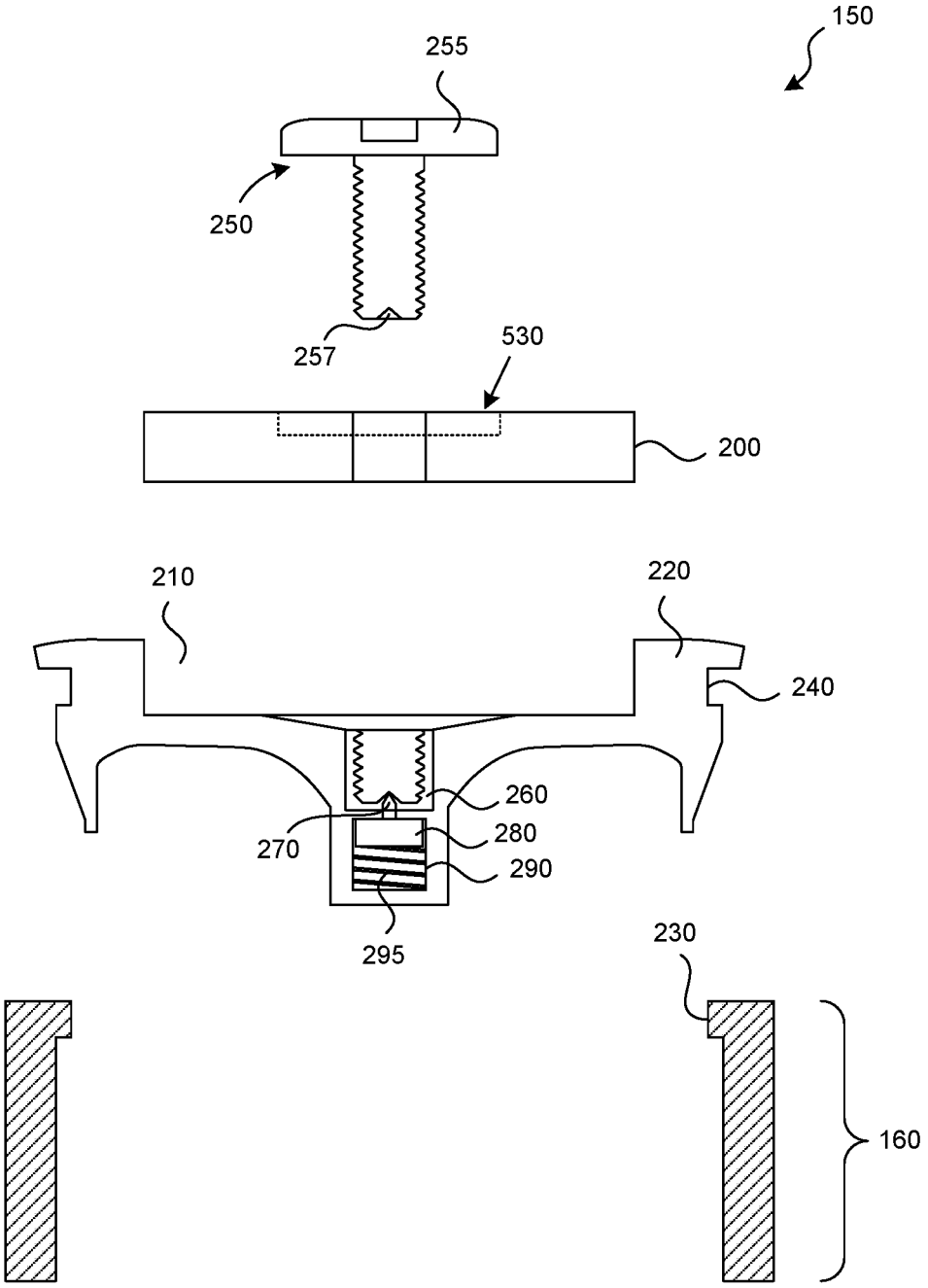
FIG. 2 is a partially exploded cross-sectional view of an embodiment of a cap assembly in accordance with an embodiment of the present technology.
Figure 3:
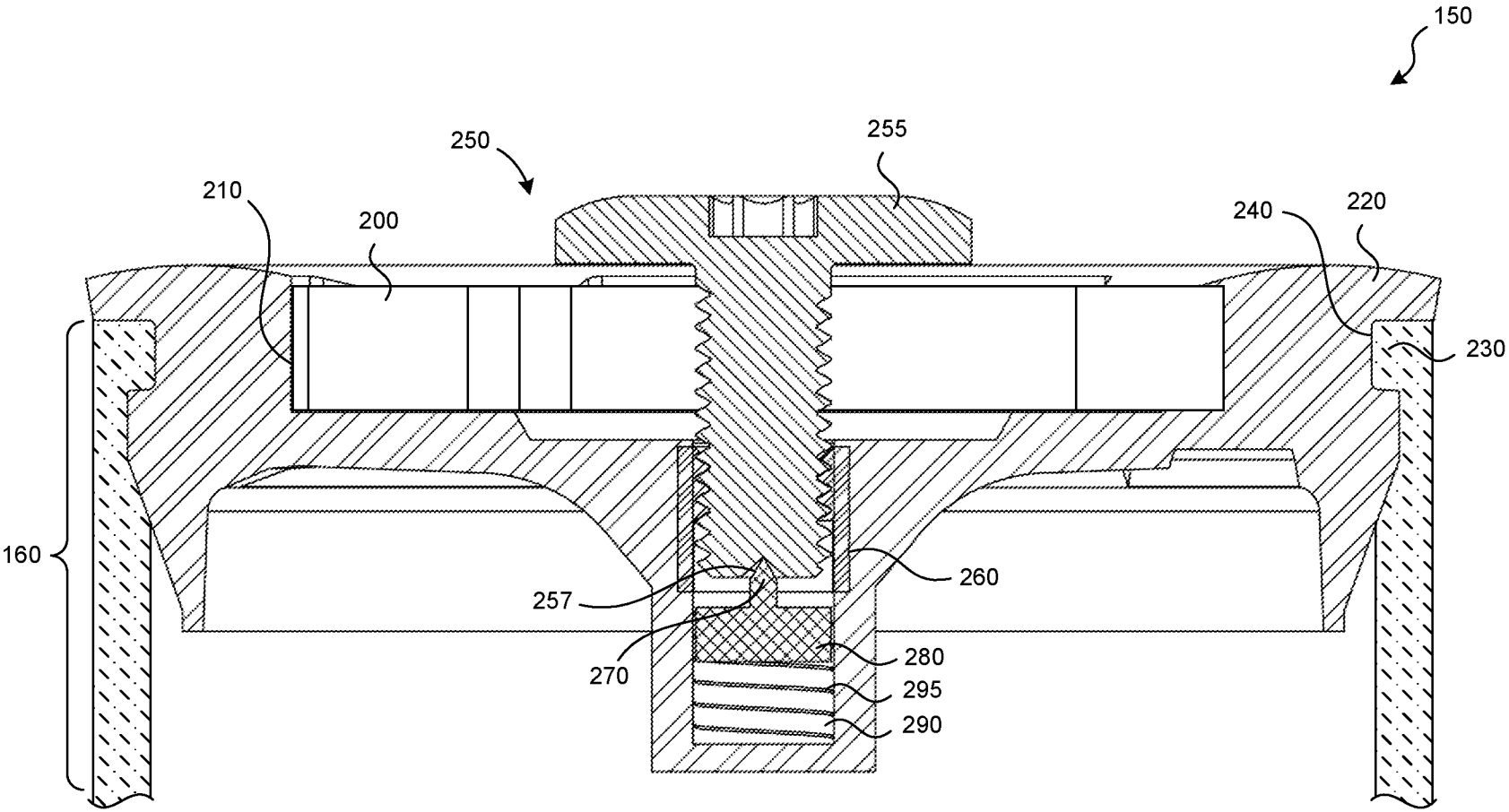
FIG. 3 is an assembled cross-sectional view of the cap assembly generally illustrated in FIG. 2.

FIGS. 2 and 3 illustrate one embodiment of a cap assembly 150 at the distal end 160 of the bat 100. The cap assembly 150 includes an interchangeable weight element 200 positioned in a receiving space or recess 210 of an end cap in the form of an end-cap cup 220. The end-cap cup 220 is permanently molded, bonded, pressed, or otherwise locked in the distal end 160 of the bat 100 in a suitable fashion, for example, by engagement between a lip 230 on the distal end 160 of the bat 100 and a groove 240 in the end-cap cup 220.

In one embodiment, as generally illustrated in FIGS. 2 and 3, the weight 200 may be in the form of a plate or disk that may be positioned within a similarly-shaped recess 210 of an end cap cup 220. Various shapes of the weight 200 are contemplated within the present technology. In one embodiment, although not specifically illustrated, a bottom face of the recess 210 may include an indentation positioned to receive a protrusion from a face of the weight 200.

A fastener in the form of a bolt 250 may pass through the weight 200 and engage a threaded bushing or bore 260 in the end cap cup 220 to secure the weight 200 in the end cap cup 220. Although not illustrated, the weight 200 may fit under an undercut in the end-cap cup 220 to help retain the weight 200.

A user may remove, replace, or change the weight element 200 to alter the amount of weight in the cap assembly 150, which in turn alters the MOI of the bat 100. Adding or removing weight at the distal end 160 has a greater effect on increasing or decreasing the MOI, which in turn allows a player to alter the swing weight of a single bat, avoiding the inconvenience and expense of transporting and maintaining multiple bats that may have inconsistent feel or performance. In addition, adjusting the MOI in this way does not alter a bat's trampoline effect, or coefficient of restitution ("BBCOR"), which often must conform to league or association performance regulations.

A manufacturer or a user may calculate the change in MOI resulting from changing weights. A change in weight at the end of the bat has the largest effect on MOI. To calculate the change in MOI when weights are changed at the end of the bat, the pivot point is assumed to be approximately near the user's grip on the bat, which may be approximately 6 inches from the knob 140. Assuming the weights are added or removed at the distal end 160 of the bat, and the pivot point is approximately 6 inches from the knob, the change in MOI can be expressed as follows:

$$\Delta\text{MOI}=(\text{weight added or subtracted})\times((\text{bat length})-6\text{ inches}-(\text{thickness of weight})/2)^2$$

In some embodiments, users may be provided with various weights that account for different ranges of MOI adjustment. In some embodiments, weights of the present technology may be provided in 0.5 ounce increments, while in other embodiments, the weights may be provided in other increments or amounts, depending on user need, materials selected, and dimensions of the weights. For example, weights may be added in increments of 5 grams to 100 grams or more to offer players their desired swing-weight adjustment.

Studies have found that high school and college baseball players using today's current bats generally want to adjust the MOI by 600 to 800 ounces-inch square, and players may not accurately discern a change in MOI below 50 ounces-inch square. Accordingly, in some embodiments, a 34-inch bat may have a preferred swing-weight range of approximately 0.1 to 1.1 ounces (2 to 30 grams). Slow-pitch softball players typically use bats ranging from 26 to 30 ounces, so a set of weights within a four-ounce range may be desirable. Such a set of weights may be packaged in a carrying case as a system that a player can transport between uses.

There are many challenges to including a removable weight at the distal end 160 of a bat 100. For example, the end of the bat 100 is a vibration node, which receives peak vibration forces even during normal play. In addition, the distal end 160 of a bat 100 may be subjected to abuse or misuse. Players may slam the end of a bat into the ground out of frustration or anger, imparting forces beyond those experienced in normal play. Despite these forces and impacts, any removable weights should not come loose, and they should be prevented from rattling or vibrating during use. In order to maintain player safety, the inventors designed several embodiments to secure one or more weights to the bat.

In one embodiment, as generally illustrated in FIGS. 2 and 3, the bolt 250 passes through the weight 200 to engage the threaded bore 260 mounted in or integral with the end-cap cup 220. In this manner, a head 255 of the bolt 250 retains the weight 200 in the end-cap cup 220. To prevent the bolt 250 from unintentionally backing out of the threaded bore 260, the bolt 250 may have a detent opening or notch 257 that engages with a flange 270 on a plunger 280 when the cap assembly 150 is assembled (as generally illustrated in FIG. 3). The plunger 280 may be positioned to move within a cavity 290 in the end-cap cup 220.

A compression spring 295 provides a biasing force to push the plunger 280 (having flange 270) toward the bolt 250. In operation, when a user threads the bolt 250 into the bore 260, the notch 257 receives the flange 270 (see FIG. 3). The spring 295 pushes the flange 270 into the notch 257, thereby applying pressure to the threads of the bolt 250 and adding friction to the threaded engagement to resist unintentional loosening of the bolt 250. In addition, the flange 270 may limit or resist unintentional rotation of the bolt 250 by engagement with the notch 257. In this manner, the weight 200 is secured to the bat 100 to avoid unintentional release of the weight 200 from the bat 100.

Figure 4:
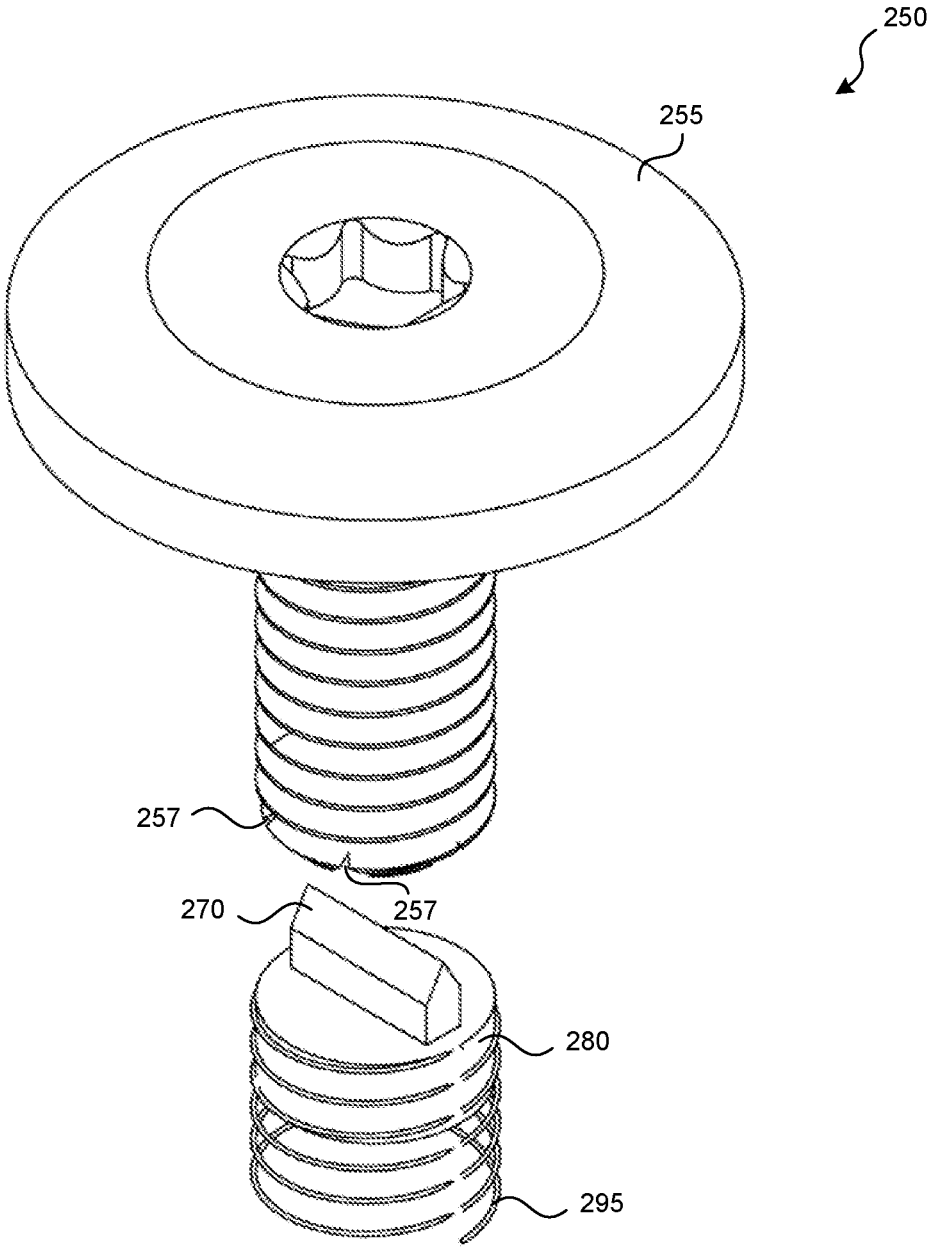
FIG. 4 is a perspective view of a bolt and plunger of the cap assembly generally illustrated in FIG. 2.

As shown in FIG. 4, the bolt 250 may have a plurality of notches 257, any of which may engage the flange 270. In some embodiments, the bolt 250 may only require a one-quarter turn to fully engage the flange 270 with a notch 257.

Figure 5:
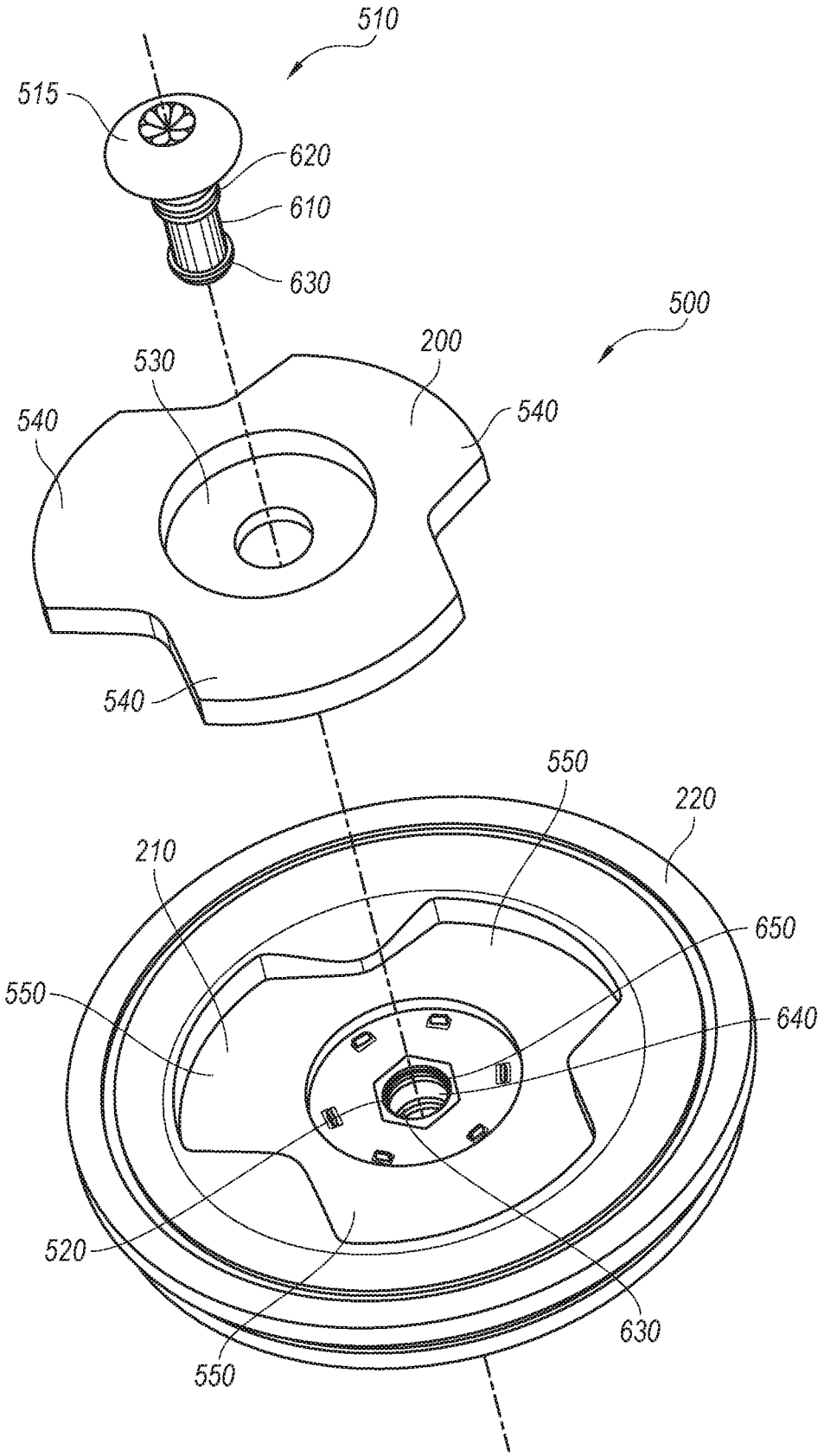
FIG. 5 is an exploded isometric view of a cap assembly in accordance with an embodiment of the present technology.

FIG. 5 illustrates a cap assembly 500 generally similar to the end-cap assembly 150 illustrated in FIGS. 2-4, but illustrating another fastening mechanism to retain the weight 200 to the end-cap cup 220. In some embodiments, including the embodiments generally illustrated in FIGS. 2-5, the weight 200 may have a counterbore 530 to accommodate at least a portion of a head (e.g., 515 or 255) of the bolt (e.g., 250 or 510) to lower the overall profile of the cap assembly (e.g., 500 or 150). And, in some embodiments, the weight 200 may be configured with a plurality of tabs 540 that generally correspond to tab openings 550 in the recess 210, such that when the weight 200 is installed in the recess 210, it is at least partially prevented from rotating within the recess 210. In other embodiments, the weight 200 and the recess 210 may have other suitable shapes, such as generally circular or square shapes.

Figure 6:
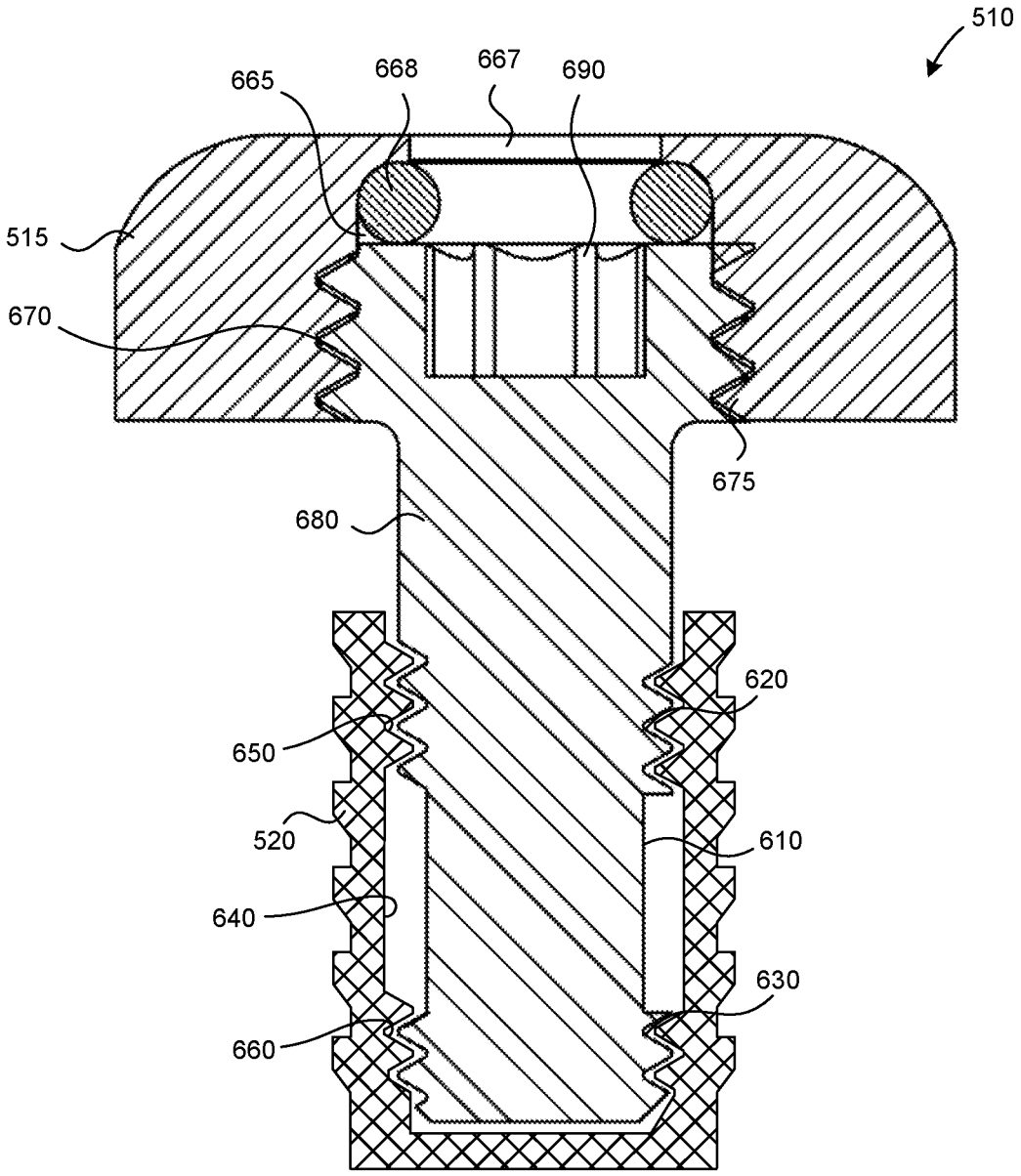
FIG. 6 is a schematic cross-sectional view of a bolt engaged in a bore in accordance with an embodiment of the present technology.
Figure 7:
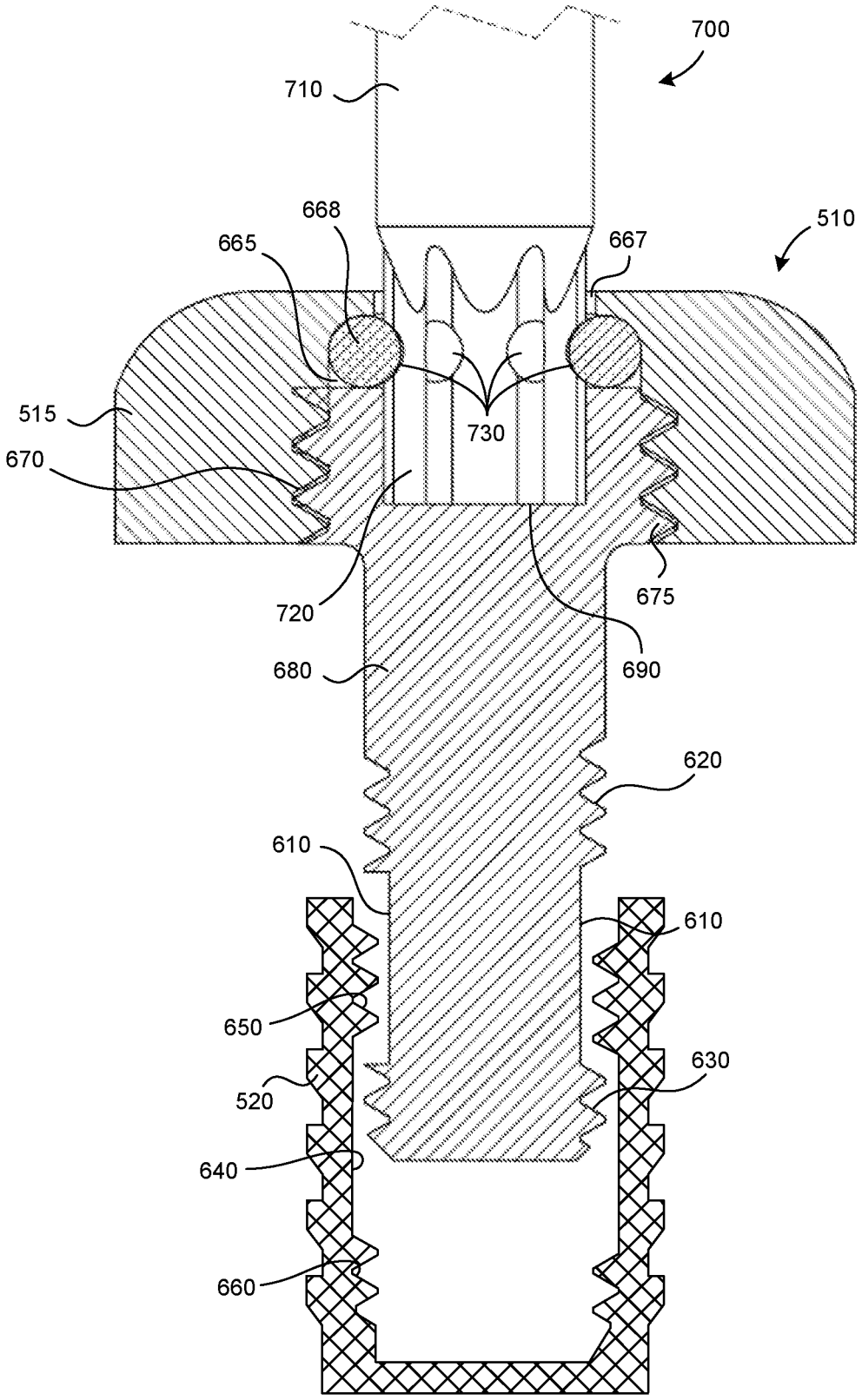
FIG. 7 is a schematic cross-sectional view of the bolt and bore generally illustrated in FIG. 6 in a partially engaged configuration.

As illustrated in FIG. 5, the weight 200 may be secured to the end-cap cup 220 using a partially-threaded bolt 510 that engages a partially-threaded bore 520 attached to or integral with the end-cap cup 220, as further described with reference to FIGS. 6-9. FIGS. 6 and 7 are schematic cross-sectional views of the partially-threaded bolt 510 engaged with the partially-threaded bore 520 to retain the weight 200 in the end-cap cup 220. FIG. 6 illustrates the bolt 510 fully engaged with the bore 520 (arranged for a user to use the bat), and FIG. 7 illustrates the bolt 510 partially engaged with the bore 520 (a partially disassembled arrangement).

The bolt 510 has an unthreaded portion 610 between an upper threaded portion 620 and a lower threaded portion 630. The bore 520 has a corresponding unthreaded portion 640 between an upper threaded portion 650 and a lower threaded portion 660. In some embodiments, the unthreaded portion 640 of the bore 520 may be longer than the threaded portions 620, 630 of the bolt 510. In a fully engaged configuration, as illustrated in FIG. 6, the lower threaded portion 630 of the bolt 510 is engaged with the lower threaded portion 660 of the bore 520, while the upper threaded portion 620 of the bolt 510 is engaged with the upper threaded portion 650 of the bore 520.

To release the weight 200 from the bat 100, a user must turn the bolt 510 to unthread the lower threaded portion 630 of the bolt 510 from the lower threaded portion 660 of the bore 520, and to unthread the upper threaded portion 620 of the bolt 510 from the upper threaded portion 650 of the bore 520. At this point in disassembly, which is illustrated in FIG. 7, the lower threaded portion 630 of the bolt 510 is captive within the unthreaded portion 640 of the bore 520, while the unthreaded portion 610 of the bolt 510 is adjacent to the upper threaded portion 650 of the bore 520. Accordingly, at this point in disassembly, no threads are engaged between the bolt 510 and the bore 520, even though the bolt 510 is still retained within the bore 520. To fully remove the bolt 510 from the bore 520 (e.g., to release the weight 200), the operator would need to pull on the bolt 510 while turning the bolt 510 to engage the lower threaded portion 630 of the bolt 510 to the upper threaded portion 650 of the bore 520 to begin threading the bolt 510 out of the upper threaded portion 650.

Accordingly, if the bolt 510 is accidentally loosened from the assembled configuration (in which the bolt 510 is fully seated in the bore 520 and engaged with both sets of threads 650, 660, generally illustrated in FIG. 6) into the partially loosened configuration generally illustrated in FIG. 7 (e.g., by vibration, impact, or other forces), the bolt 510 would remain captive in the bore 520, thereby preventing the bolt 510 and the weight 200 from accidentally releasing from the bat 100. Instead, in the partially loosened configuration (FIG. 7), the weight 200 and the bolt 510 would rattle to warn the user that the bolt 510 is loose and should be tightened.

Standard bolt heads are not designed to be simultaneously pulled and rotated with a single tool. Accordingly, while some embodiments of the present technology may incorporate a standard bolt head, such as a hexagonal head, a hexagonal-socket head, a slotted head, a crosshead, or other suitable heads for use with commonly available tools, other embodiments of the present technology provide a bolt head 515 that facilitates simultaneous pulling and turning of the bolt 510 to engage the lower threaded portion 630 of the bolt 510 with the upper threaded portion 650 of the bore 520 to facilitate removal of the bolt 510.

FIGS. 6 and 7 illustrate such a bolt head 515 to facilitate simultaneous pulling and turning of the bolt 510 in accordance with an embodiment of the present technology. The bolt head 515 may have an internal cavity 665 with an outer diameter larger than an opening 667 on the top of the bolt head 515. An O-ring 668 may be positioned in the cavity 665. The bolt head 515 may also have a threaded portion 670 that engages with corresponding shaft threads 675 at the top of a shaft 680 of the bolt 510. Accordingly, the bolt 510 may be formed from multiple pieces, such that the bolt head 515 is threaded onto the bolt shaft 680. An adhesive or thread-locking compound may be used to affix the shaft threads 675 to the threaded portion 670 of the bolt head 515. The top of the bolt shaft 680 may also have a socket 690 shaped or configured to receive a correspondingly shaped tool for providing torque to the bolt 510.

FIG. 7 shows one such tool 700. The tool 700 includes a tool shaft portion 710 and a tool driver portion 720. The tool driver portion 720 is shaped and sized to pass through the opening 667 to engage the socket 690. The tool driver portion 720 has a plurality of depressions or divots 730 positioned to engage the O-ring 668 when the tool driver portion 720 is in the bolt head 515. Pressure and friction from the O-ring 668 engaged with the divots 730 allow the user to pull on the tool 700 while applying torque to the bolt 510 to remove the bolt 510 from the bore 520 in the end-cap cup 220. In some embodiments, a spiral retaining ring may be used instead of the O-ring.

Figure 7A:
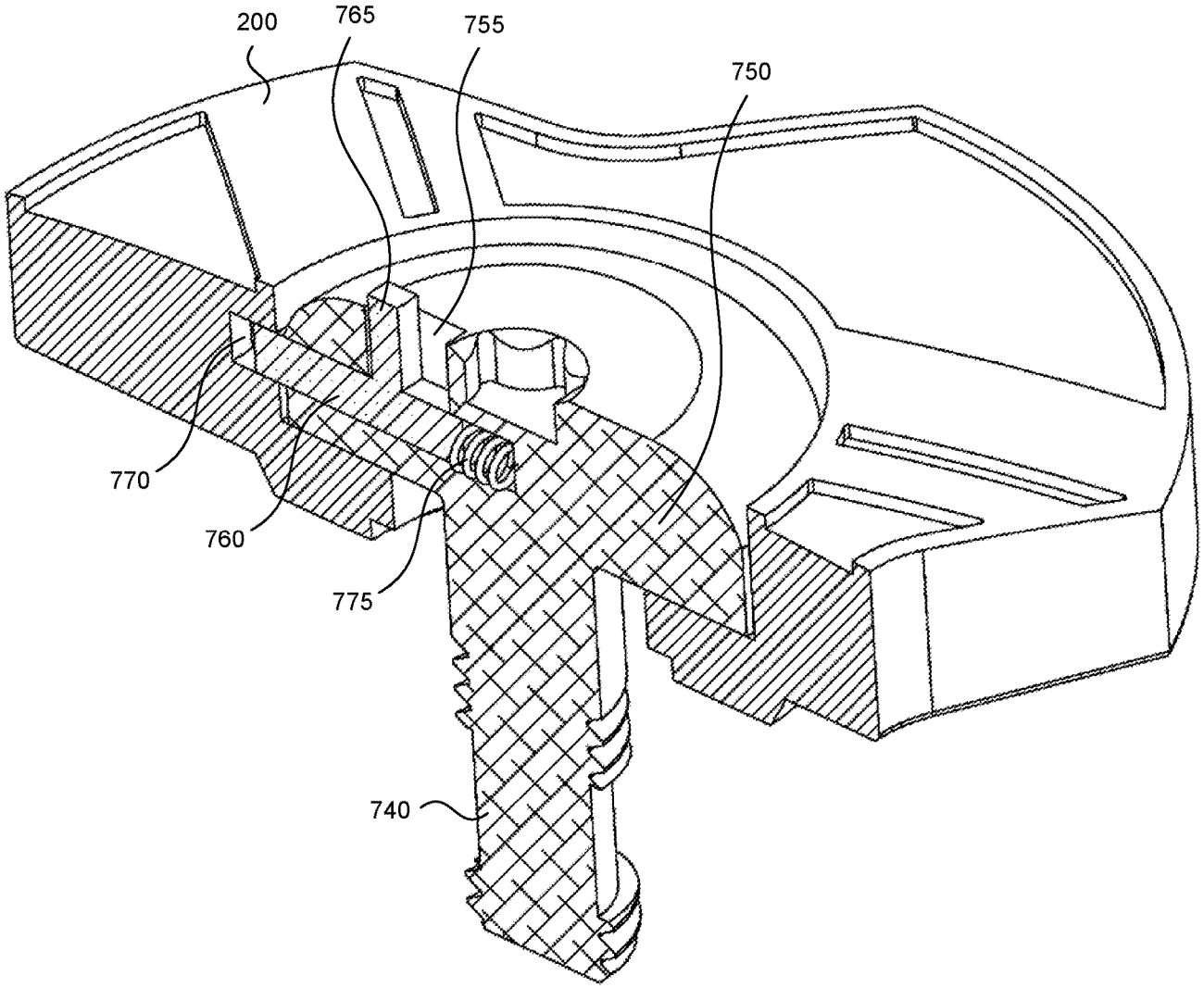
FIGS. 7A and 7B illustrate a bolt configured to resist unintended rotation in accordance with an embodiment of the present technology.
Figure 7B:
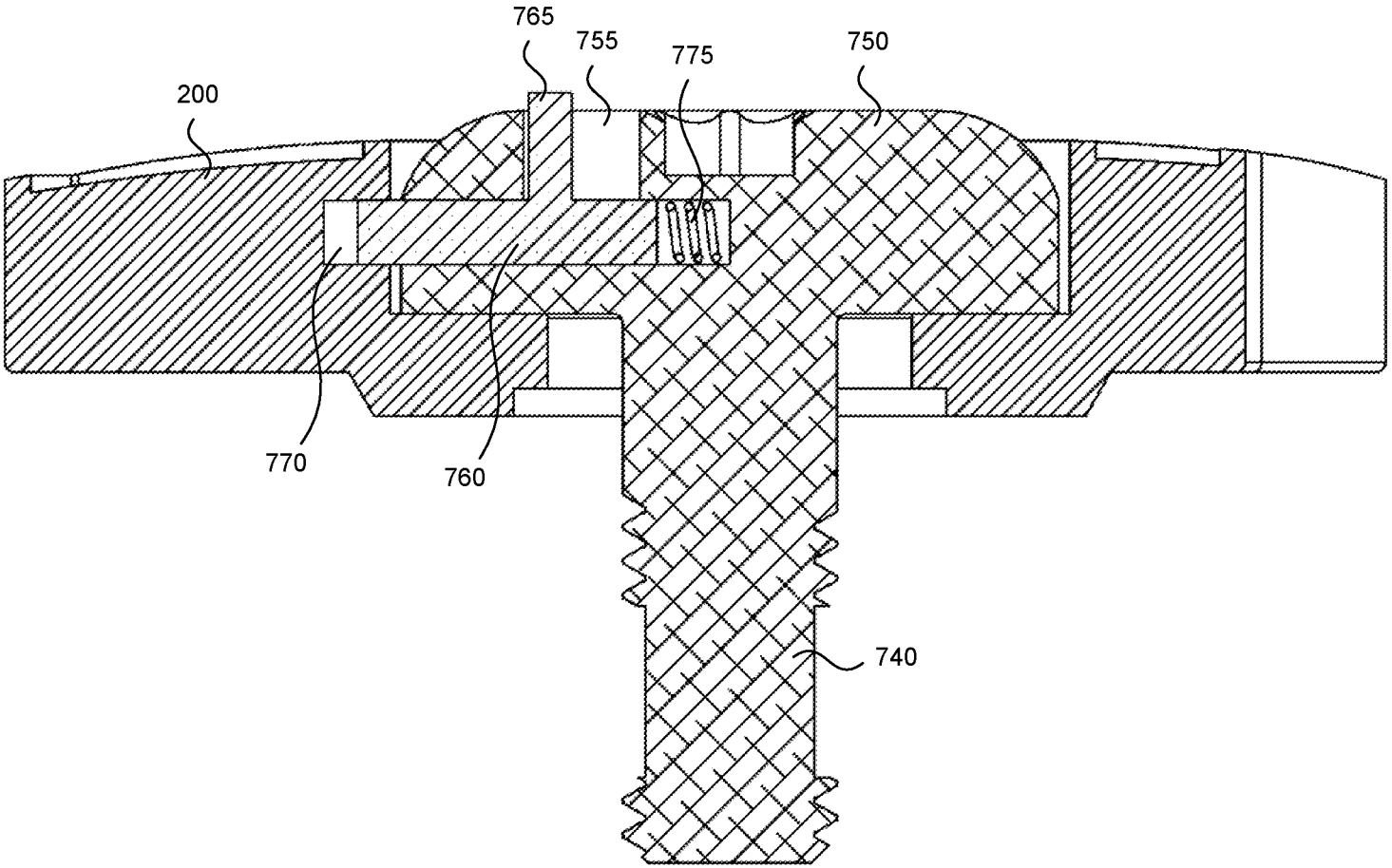

FIGS. 7A and 7B illustrate a bolt 740 configured to resist unintended rotation and subsequent loosening in accordance with an embodiment of the technology. The head 750 of the bolt 740 may have an opening 755 shaped to accommodate a tab or latch 760 positioned to slide within the head 750 (i.e., in the opening 755). In some embodiments, the latch 760 may be t-shaped, for example.

A user seeking to allow the bolt 740 to rotate can push on a toggle 765 of the latch 760 to slide the latch 760 inward toward the center of the head 750, which causes the latch 760 to back out of a recess 770 in a weight 200. When the latch 760 is cleared from the recess 770, the bolt 740 can rotate. When the latch 760 is in the recess 770, the bolt 740 will be engaged with the weight 200 to resist rotation of the bolt 740. A compression spring 775 in the opening 755 may bias the latch 760 toward engagement with the recess 770.

In some embodiments, a latch (e.g., 760) may be part of the weight 200 or another part of a cap assembly, while a recess (e.g., 770) may be located in part of a bolt (e.g., 740, such as the head 750) such that the latch engages with the bolt to resist rotation.

The bolt 740 may retain a weight 200 in a similar manner as described above. For example, as described above in regards to FIG. 5, the weight 200 itself may be prevented from rotating by the engagement of the tabs 540 that generally correspond with tab openings 550 in the recess 210. In some embodiments similar to those generally illustrated in FIGS. 2-4, the bolt 740 may have a detent opening or notch that engages with a flange on a plunger when the cap assembly is assembled. In other embodiments, the bolt 740 may be partially threaded to engage with a partially threaded bore in a similar manner as the embodiments generally illustrated in FIGS. 5-7.

Figure 8:
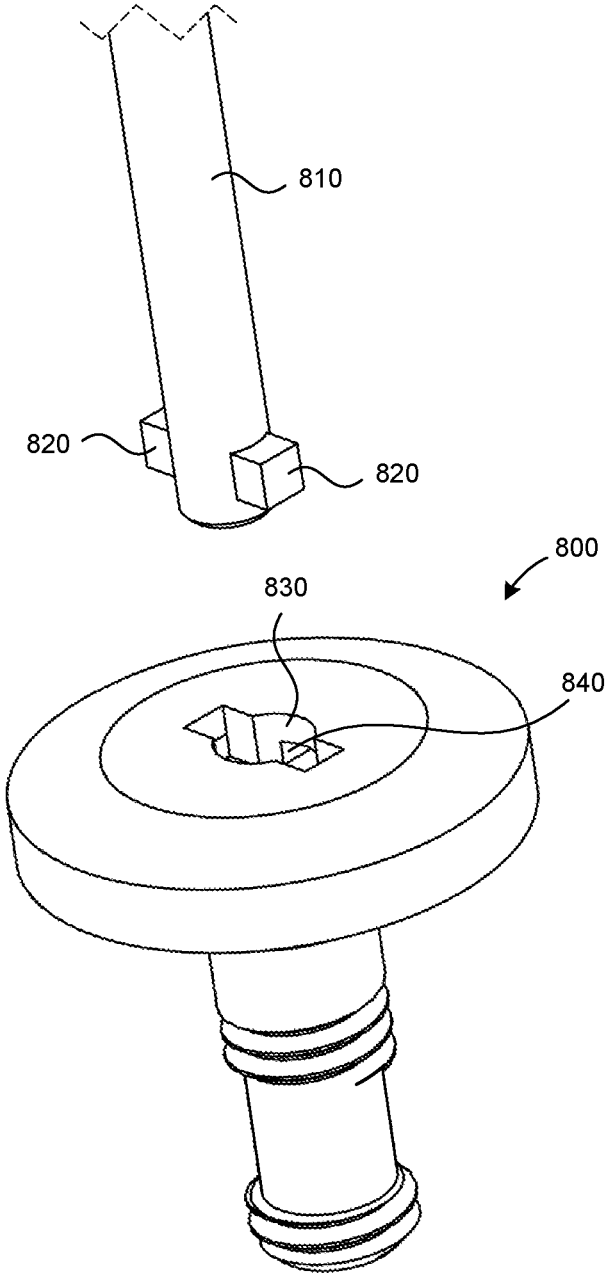
FIG. 8 is an isometric view of a tool and a bolt in accordance with an embodiment of the present technology.
Figure 9:
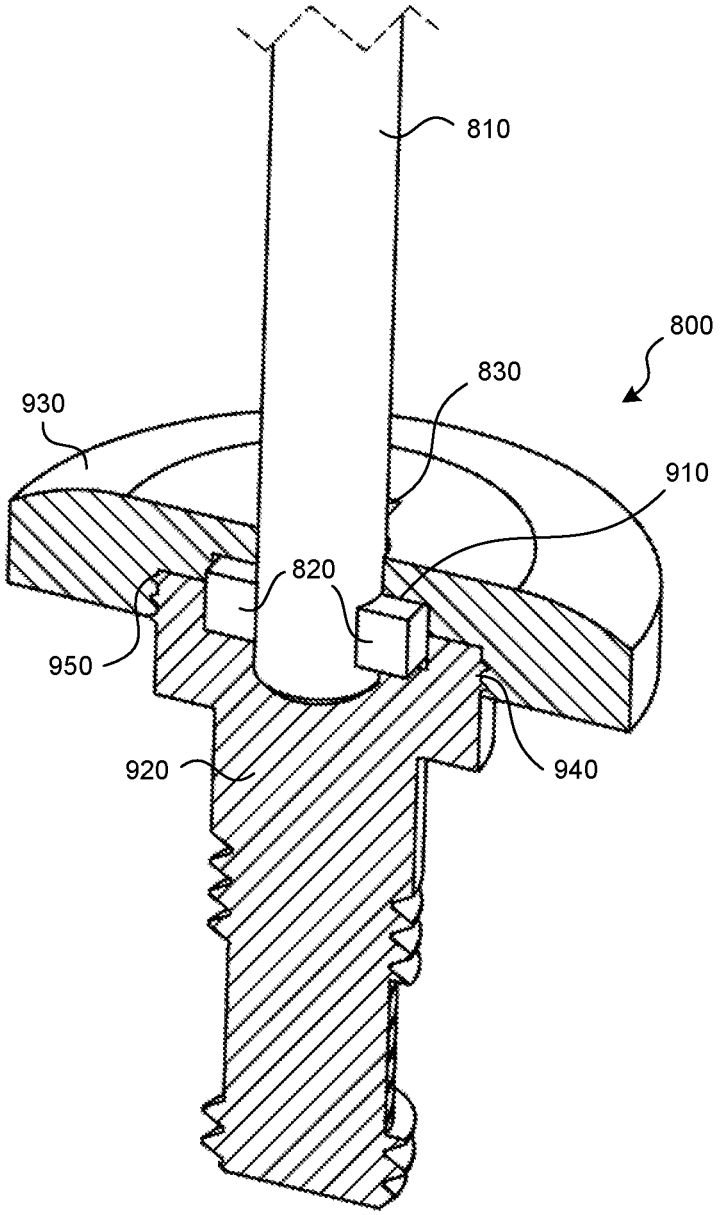
FIG. 9 is a generally cross-sectional view of the tool and bolt shown in FIG. 8.

FIGS. 8 and 9 illustrate a bolt 800 configured to facilitate simultaneous pulling and twisting to aid in removal of the bolt 800 from the bore 520 in accordance with another embodiment of the present technology. FIG. 8 illustrates an isometric view of a tool 810 approaching the bolt 800. The tool 810 includes a shaft having one or more protrusions or lobes 820 that pass through an opening 830 in the bolt 800. Upon entering the opening 830, the tool 810 may be rotated to engage the lobes 820 with interior faces 840 of the bolt 800. The interior faces 840 prevent rotation of the tool 810 within the bolt 800 to allow torque to transfer from the tool 810 to the bolt 800.

FIG. 9 illustrates a generally cross-sectional view of the bolt 800 engaged with the tool 810. An interior upper face 910 blocks the lobes 820 from being pulled out of the bolt 800 during use of the tool 810. The bolt 800 may be manufactured in two pieces. For example, the bolt 800 may be manufactured from a bolt shaft 920 and a bolt head 930. The bolt shaft 920 may have a threaded upper portion 940 that engages with a threaded portion 950 in the bolt head 930. Accordingly, the opening 830 and the faces (e.g., 840, 910) forming the interior of the bolt head 930 may be machined or manufactured before assembling the bolt head 930 to the bolt shaft 920. An adhesive or thread locking compound may be used to affix the threaded upper portion 940 of the shaft 920 to the threaded portion 950 of the bolt head 930. In some embodiments, the tools 700, 810 may not be required to tighten their respective bolts 510, 800, such as when a user is able to physically grasp the bolts 510, 800.

Although the embodiments illustrated in FIGS. 1-9 may use a discrete weight positioned in the end-cap cup (e.g., 220), in some embodiments, the bolt (e.g., 250, 510) may be formed integrally with the weight so that a user may simultaneously remove the bolt and the weight. In other embodiments, a lightweight washer or spacer may be used in place of a weight 200 when no additional weight is desired. In some embodiments, the bolts (e.g., 250, 510) may have an overall length of approximately 0.7 inches, with a shaft diameter of approximately 0.2 inches, while in other embodiments, the bolts may have other suitable dimensions. In some embodiments, the weights 200 may have a radius of approximately 0.67 inches and a thickness of approximately 0.06 inches, although other weights 200 may have other suitable dimensions, dependent upon the desired amount of weight and the material forming the weights.

Figure 10:
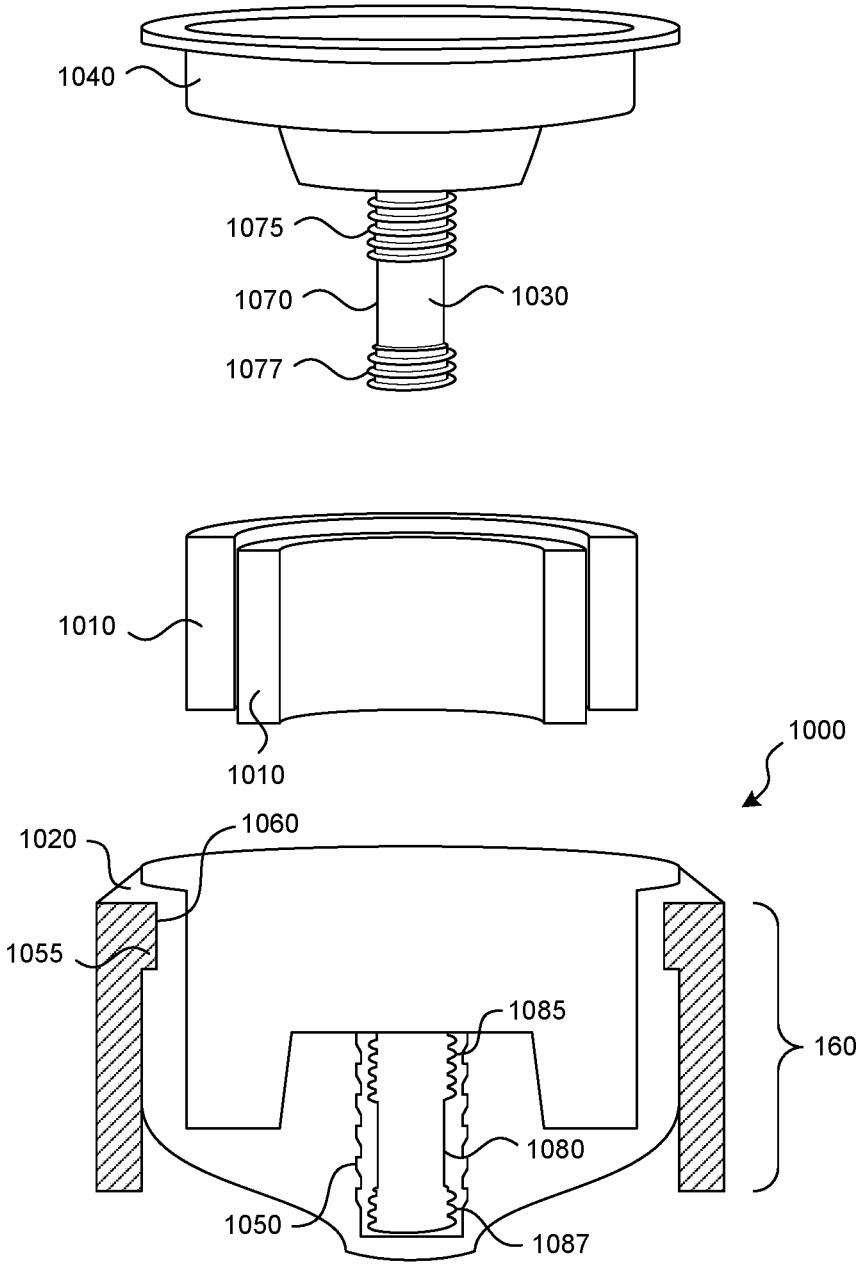
FIG. 10 is a schematic cross-sectional exploded view of a cap assembly in accordance with an embodiment of the present technology.
Figure 11:
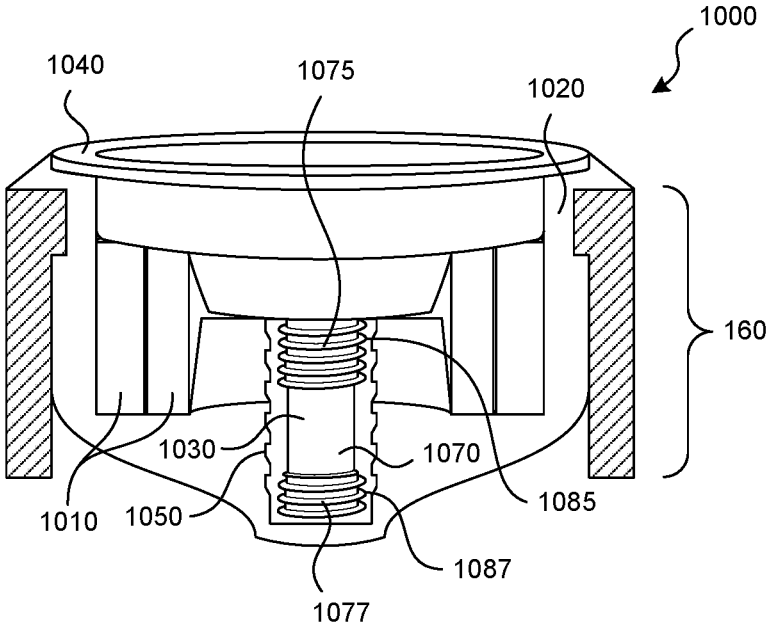
FIG. 11 is a schematic cross-sectional assembled view of the cap assembly illustrated in FIG. 10.
Figure 12:
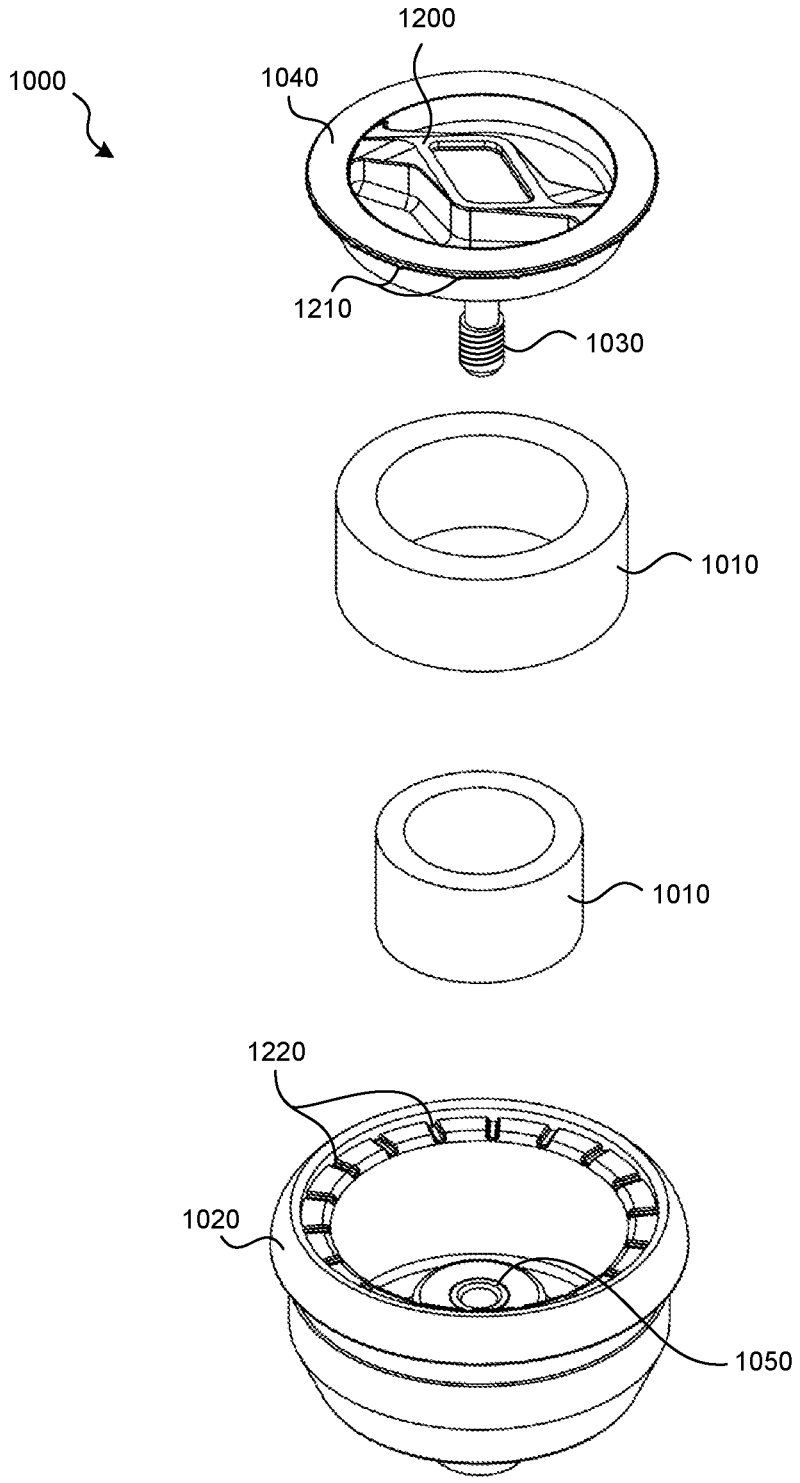
FIG. 12 is an isometric exploded view of the cap assembly illustrated in FIG. 10.

FIGS. 10-12 illustrate a cap assembly 1000 in accordance with another embodiment of the present technology. In the cap assembly 1000, a plurality of weights 1010 may be in the form of rings positioned concentrically within an end-cap cup 1020. Although two weights 1010 are illustrated, in other embodiments, there may be a single weight 1010, and, in other embodiments, there may be more than two weights 1010. In yet other embodiments, there may be no weights 1010. When the cap assembly 1000 is assembled, the weights 1010 are positioned concentrically around a threaded bolt 1030, which spans from an end cap lid 1040 to engage a threaded insert, bushing, or bore 1050 in the end-cap cup 1020 to secure the lid 1040 to the end-cap cup 1020, thereby retaining the weights 1010 in the cap assembly 1000 beneath the lid 1040.

The end-cap cup 1020 may be attached to the distal end 160 of the bat 100 by engagement between a lip 1055 on the distal end 160 of the bat 100 and a groove 1060 in the end-cap cup 1020, similar to the attachment between the end-cap cup 220 and the distal end 160 described above with respect to FIGS. 2 and 3. In other embodiments, the end-cap cup 1020 may be attached to the distal end 160 via other suitable engagements. The threaded insert or bore 1050 may be pre-molded in the end-cap cup 1020 or it may be machined into the end-cap cup 1020. The bore 1050 may be positioned in the end-cap cup 1020 in other suitable ways, such as by pressing the bore 1050 into the end-cap cup 1020. In some embodiments, the bolt 1030 may be molded into the lid 1040. In other embodiments, the bolt 1030 may be fastened to the lid 1040 in an otherwise suitable manner.

To ensure that the lid 1040 is secured to the end-cap cup 1020, the bolt 1030 and the bore 1050 may each be partially threaded, similar to the bolt 510 and bore 520 illustrated and described above with regard to FIGS. 6 and 7. The bolt 1030 may have an unthreaded portion 1070 between an upper threaded portion 1075 and a lower threaded portion 1077. The bore 1050 may also be partially threaded, having an unthreaded portion 1080 between an upper threaded portion 1085 and a lower threaded portion 1087. In some embodiments, the unthreaded portion 1080 of the bore 1050 may be longer than the threaded portions 1075, 1077 of the bolt 1030. In a fully engaged configuration, as generally illustrated in FIG. 11, in which the weights 1010 are secured, the lower threaded portion 1077 of the bolt 1030 is engaged with the lower threaded portion 1087 of the bore 1050, while the upper threaded portion 1075 of the bolt 1030 is engaged with the upper threaded portion 1085 of the bore 1050.

To release the weights 1010 from the bat 100, a user turns the lid 1040 (which turns the bolt 1030) to release the lower threaded portion 1077 of the bolt 1030 from the lower threaded portion 1087 of the bore 1050, and to release the upper threaded portion 1075 of the bolt 1030 from the upper threaded portion 1085 of the bore 1050, similar to the bolt 510 in FIGS. 6 and 7. At this point in disassembly (not illustrated, but generally similar to the arrangement of the bolt 510 in the bore 520 illustrated in FIG. 7), the lower threaded portion 1077 of the bolt 1030 is captive within the unthreaded portion 1080 of the bore 1050, while the unthreaded portion 1070 of the bolt 1030 is in the upper threaded portion 1085 of the bore 1050. Accordingly, no threads are engaged between the bolt 1030 and the bore 1050, yet the bolt 1030 remains retained within the bore 1050 and attached to the bat 100, preventing the weights 1010 from escaping the end-cap cup 1020 until the lid 1040 is fully removed.

Similar to the embodiment described above with regard to FIGS. 6 and 7, if the bolt 1030 is accidentally loosened from the assembled configuration (e.g., as illustrated in FIG. 11) into the partially loosened configuration (e.g., as illustrated in FIG. 7), the bolt 1030 (and, in turn, the lid 1040) would remain captive in the bore 1050, thereby preventing the lid 1040 from coming off of the end-cap cup 1020 and keeping the weights 1010 in the end-cap assembly 1000. Instead, the weights 1010 and the lid 1040 would rattle to warn the user that the bolt 1030 is loose and that the lid 1040 should be tightened.

FIG. 12 illustrates an isometric exploded view of the cap assembly 1000. In one embodiment of the technology, the lid 1040 may have a contoured finger grip or rib 1200 for a user to grasp while turning the lid 1040 to tighten or loosen the bolt 1030. The rib 1200 further allows a user to pull on the lid 1040 (and the bolt 1030) while rotating the lid 1040 to engage the lower threaded portion 1077 with the upper threaded portion 1085 (as generally illustrated and described above with respect to FIGS. 10 and 11) to enable full removal of the lid 1040.

In some embodiments, the lid 1040 may have strips or ridges 1210 protruding from a portion of the lid 1040 in contact with the end-cap cup 1020. The end-cap cup 1020 may have a corresponding arrangement of notches or slots 1220 positioned to partially receive the ridges 1210. During installation and removal of the lid 1040, a user may hear audible feedback, and sense physical feedback in the form of a clicking noise or sensation, as the ridges 1210 and slots 1220 engage and disengage during rotation of the lid 1040. The engagement of the ridges 1210 and slots 1220 can additionally help prevent the lid 1040 from rotating on its own. Accordingly, in some embodiments, a fully-threaded bolt may be used, and a lid 1040 with ridges 1210 engaged with slots 1220 in a cup 1020 may be sufficient to prevent the lid 1040 from loosening from the cup 1020. In some embodiments, the end-cap cup may include the ridges, while the lid may include the slots. In other embodiments, the end-cap cup and the lid may each have slots and ridges.

The lid 1040 may be formed from a clear or translucent polycarbonate material, or it may be formed from other suitable materials, and it may be colored or otherwise decorated. In some embodiments, the weights 1010 (and, similarly, other weights disclosed herein, such as weights 200 described above for FIGS. 2 and 3) may be made from steel and coated in a colored material or paint, for example, they may be coated in a soft or resilient material. In other embodiments, any of the weights disclosed herein may be made from zinc or another suitable metal. Any of the weights disclosed herein may have a printed, engraved, or otherwise marked indication of the amount of weight. The end-cap cups (e.g. 220, 1020) may be formed from a plastic or rubber material, or from other suitable materials. The threaded elements described herein, such as the bolts (e.g., 250, 510, 800, 1030) and bores (e.g., 260, 520, 1050), may be made from steel, aluminum, or any other suitable material.

In further embodiments, although not illustrated, a plurality of smaller weights may be placed in a sealable chamber within a bat end cap. The sealable chamber may have fastening features and lids similar to those disclosed herein. The smaller weights may include various amounts of sand, water, steel shot, or other small or fine particles. An elastomeric filler plug (e.g., polyurethane, ethylene vinyl acetate, rubber, foam, or other suitable materials), or a spring and plunger, could be used to apply pressure to the smaller weights to help reduce noise or vibration from movement during use of the bat.

In some embodiments, weights or lids similar to those disclosed herein can be fastened to the bat end cap using a standard quarter turn fastener. In some embodiments, the quarter turn fastener may be combined with a secondary lock to prevent rotation in a vibration environment, such as a plunger (e.g., 280) described herein with regard to FIGS. 2-4. In some embodiments, a retractable tab or latch that fits into a mating slot of the head of the fastener or into part of the weight or another part of the cap assembly can provide a secondary lock to resist accidental release of the fastener, such as the latches described above with regard to FIGS. 7A and 7B. Such a latch would require an operator to retract the latch while releasing the quarter turn fastener. A locking slot may be in many different positions, such as the side, top, or bottom faces of a fastener head, or on a bottom portion of the shaft of the fastener, or in the threaded sections of the shaft of the fastener.

From the foregoing, it will be appreciated that specific embodiments of the disclosed technology have been described for purposes of illustration, but that various modifications may be made without deviating from the technology, and elements of certain embodiments may be interchanged with those of other embodiments. For example, in some alternative embodiments in which mechanisms are used to secure covers or lids to end caps to prevent loosening or release of the lids (such as the lid 1040 and the cup 1020), the bolts (e.g., 1030) may mate with a lock washer or other thread-lock feature. In other embodiments, locking tabs in the threaded inserts or bores (e.g., 1050) could engage axial slots in the bolts. In yet other embodiments, lids may be secured to end-cap cups using distorted threads, oversized threads that increase friction, or serrated washers.

In other embodiments, soft materials may be used in the weights or end-cap cup assemblies to prevent buzzing or rattling between properly assembled parts. In still other embodiments in which a partially threaded bore is used (e.g., partially threaded bore 520 in FIGS. 5-7), the partially threaded bore may not include a lower threaded portion (e.g., 660), and it may only have an upper threaded portion (e.g., 650). In some embodiments, the end-cap cups (e.g., 220, 1020) may be formed integrally with a ball bat.

Further, while advantages associated with certain embodiments of the disclosed technology have been described in the context of those embodiments, other embodiments may also exhibit such advantages, and not all embodiments need necessarily exhibit such advantages to fall within the scope of the technology. Accordingly, the disclosure and associated technology may encompass other embodiments not expressly shown or described herein, and the invention is not limited except as by the appended claims.

What is claimed is:

1. An end-cap assembly for a ball bat, the end-cap assembly comprising:

an end-cap cup including a threaded bore;

one or more weights removably positioned within the end-cap cup;

a removable lid positioned to cover the one or more weights; and a threaded fastener projecting from the lid and positioned to engage the threaded bore when the lid is secured to the end-cap cup;

wherein the threaded fastener includes an upper threaded portion, a lower threaded portion, and an unthreaded portion positioned between the upper threaded portion and the lower threaded portion; and the threaded bore comprises a threaded portion and an unthreaded portion;

wherein the upper threaded portion of the fastener is positioned to engage the threaded portion of the bore when the lid is in a first configuration; and wherein the lower threaded portion of the fastener is positioned in the unthreaded portion of the bore when the lid is in a second configuration.

2. The end-cap assembly of claim 1 wherein the one or more weights comprises a plurality of weights.

3. The end-cap assembly of claim 2 wherein the plurality of weights comprises a plurality of rings positioned concentric to one another.

4. The end-cap assembly of claim 1, wherein the threaded portion of the threaded bore is an upper threaded portion, the threaded bore further comprises a lower threaded portion, and wherein the unthreaded portion of the threaded bore is positioned between the upper threaded portion of the threaded bore and the lower threaded portion of the threaded bore.

5. The end-cap assembly of claim 1 wherein the lid comprises a rib positioned to be grasped by a user to control movement of the lid relative to the end-cap cup.

6. The end-cap assembly of claim 1 wherein the end-cap cup includes a cavity containing a plunger and a compression spring configured to bias the plunger toward the fastener, wherein the plunger includes a flange, and wherein the fastener includes a notch positioned to engage the flange to at least partially resist rotation of the fastener.

7. The end-cap assembly of claim 1 wherein the end-cap cup comprises a plurality of slots positioned to receive a corresponding plurality of ridges on the lid, or wherein the lid comprises a plurality of slots positioned to receive a corresponding plurality of ridges on the end-cap cup.

8. The end-cap assembly of claim 1 wherein the end-cap cup comprises a groove positioned to engage a lip on a distal end of a ball bat.

9. An end-cap assembly for a ball bat, the end-cap assembly comprising:

a cup comprising a recess configured to receive one or more weights, the cup further comprising a bore having a threaded portion and an unthreaded portion;

a bolt having an upper threaded portion, a lower threaded portion, and an unthreaded portion positioned between the upper threaded portion and the lower threaded portion; and a lid configured to cover the recess, wherein the bolt is attached to the lid;

wherein the upper threaded portion of the bolt engages the threaded portion of the bore when the bolt is in a first configuration; and wherein the lower threaded portion of the bolt is positioned in the unthreaded portion of the bore when the bolt is in a second configuration.

10. The end-cap assembly of claim 9, further comprising one or more weights configured to be positioned in the recess.

11. The end-cap assembly of claim 10 wherein the one or more weights comprises a plurality of rings configured to be arranged concentrically relative to one another around the bolt.

12. The end-cap assembly of claim 9 wherein the cup includes a cavity containing a plunger and a compression spring configured to bias the plunger toward the bolt, wherein the plunger includes a flange, and wherein the bolt includes a notch positioned to engage the flange to at least partially resist rotation of the bolt.

13. An end-cap assembly for a ball bat, the end-cap assembly comprising:

an end-cap cup including a threaded bore;

a removable lid; and a threaded fastener projecting from the lid and positioned to engage the threaded bore when the lid is secured to the end-cap cup; wherein:

the threaded fastener includes a threaded portion and an unthreaded portion;

the threaded bore comprises a threaded portion and an unthreaded portion;

the threaded portion of the fastener is positioned to engage the threaded portion of the bore when the lid is in a first configuration; and the threaded portion of the fastener is positioned in the unthreaded portion of the bore when the lid is in a second configuration, wherein the second configuration comprises the fastener being captive in the bore.

14. The end-cap assembly of claim 13, further comprising one or more weights removably positioned within the end-cap cup, wherein the removable lid is positioned to cover the one or more weights.

15. The end-cap assembly of claim 14 wherein the one or more weights comprises a plurality of rings positioned concentric to one another.

16. The end-cap assembly of claim 13, wherein the threaded portion of the threaded bore is an upper threaded portion, the threaded bore further comprises a lower threaded portion, and wherein the unthreaded portion of the threaded bore is positioned between the upper threaded portion of the threaded bore and the lower threaded portion of the threaded bore.

17. The end-cap assembly of claim 13 wherein the end-cap cup comprises a plurality of slots positioned to receive a corresponding plurality of ridges on the lid, or wherein the lid comprises a plurality of slots positioned to receive a corresponding plurality of ridges on the end-cap cup.

18. An end-cap assembly for a ball bat, the end-cap assembly comprising:

an end-cap cup including a threaded bore;

one or more weights removably positioned within the end-cap cup;

a removable lid positioned to cover the one or more weights; and a threaded fastener projecting from the lid and positioned to engage the threaded bore when the lid is secured to the end-cap cup;

wherein the end-cap cup includes a cavity containing a plunger and a compression spring configured to bias the plunger toward the fastener, wherein the plunger includes a flange, and wherein the fastener includes a notch positioned to engage the flange to at least partially resist rotation of the fastener.

* * * * *